United States Patent [19]

Hann

[11] Patent Number: 4,774,826

[45] Date of Patent: Oct. 4, 1988

[54] METHOD OF MAKING A CONTAINER FROM A MATERIAL EXHIBITING SUPERPLASTICITY

[75] Inventor: Volker Hann, Jork-Koenigreich, Fed. Rep. of Germany

[73] Assignee: MBB GmbH, Bremen, Fed. Rep. of Germany

[21] Appl. No.: 939,546

[22] Filed: Dec. 9, 1986

[30] Foreign Application Priority Data

Dec. 10, 1985 [DE] Fed. Rep. of Germany ..... 3543523

[51] Int. Cl.[4] ..... B21D 26/02

[52] U.S. Cl. ..... 72/54; 72/58; 72/61; 72/709; 264/572; 264/574

[58] Field of Search ..... 72/709, 54, 56, 58, 72/61; 65/71, 79, 102, 107, 110, 261; 264/572, 574

[56] References Cited

U.S. PATENT DOCUMENTS

| | | | |
|---|---|---|---|
| 703,618 | 7/1902 | Sievert | 65/110 |
| 3,184,297 | 5/1965 | Van Zonneveld | 65/108 |
| 3,694,178 | 9/1972 | Hennequin | 65/110 |

FOREIGN PATENT DOCUMENTS

| | | | |
|---|---|---|---|
| 2426601 | 4/1975 | Fed. Rep. of Germany | 72/709 |

OTHER PUBLICATIONS

"The Superplastics—A Complete List", Science and Technology, Sep. 1968, p. 49.

*Primary Examiner*—David Jones
*Attorney, Agent, or Firm*—Ralf H. Siegemund

[57] ABSTRACT

A hollow sphere is made of a superplastic material and blown to a large size, unrestricted or with restriction in one or two directions. The unrestricted hollow sphere may be rotated while being blown.

10 Claims, 2 Drawing Sheets

METHOD OF MAKING A CONTAINER FROM A MATERIAL EXHIBITING SUPERPLASTICITY

BACKGROUND OF THE INVENTION

The present invention relates to the manufacture of containers made of a material which under certain conditions exhibit superplastic properties.

It is known that certain metals for example Ti and Ti alloys exhibit the property also known as superplasticity. A superplastic material has specifically the ability to exhibit unusually high lasting elongations under tension with a commensurate reduction in cross section but without rupture. A superplastic material, therefore, has the advantage that rather complex components and shapes can be made with one single forming step. On the other hand, in the case of containers e.g. spherical containers for fuel to be used in space vehicles, it was the practice to construct such a container from half shells or semispheres and to make these through a machining process. The two semi-spheres are then bonded into a spherical tank configuration. Such a manufacture process requires complex tools, fairly expensive semi-finished products and complex clamping and position devices which have to match the various shapes and sizes and so forth. While a satisfactory product can be obtained in that fashion the manufacturing process is deemed cumbersome and therefore undesirable and subject to need for improvement.

DESCRIPTION OF THE INVENTION

It is an object of the present invention to provide a new and improved method to make spherical containers or the like without expenditure as was heretofore deemed necessary.

It is a particular feature of the present invention to provide a new and improved containers such as spherical containers to be used as a tank in space vehicles under utilization of a material that can be superplastically deformed.

In accordance with the preferred embodiment of the present invention it is suggested to provided first a hollow sphere of a superplastic material with a pressure nipple or connection and having a thickness considerably thicker than the wall thickness of the desired product. This sphere is then pressurized and widened at a Temperature necessary for obtaining superplastic behaviour. In the case of Ti or a Ti alloy the temperature should be about 850°-950° C. The sphere is rotated during the expansion on account of the pressurization.

The inventive feature has the advantage that any kind of spherical size can be made without requiring different and expensive forming and shaping tools, machine tools, clamping devices etc.. Rotating or turning the sphere during the forming process in a furnace or to let it float in a heated liquid, has the advantage that one avoids the irregularities as the sphere expands.

It may also be useful to modify the shaping process to obtain shaped different from a sphere. One may still start with a spherical hollow blank as stated, place it into a tube and blow the sphere so that the wall abuts and follows the contour of that tube. This way one obtains a bottle-like kind of container. Alternatively one may provide two plates positioned at a spaced relationship, place the hollow spherical blank in between these plates and blow pressurized air into it; the resulting contours are flat with uniform spacing between the plates and in the transverse direction it is circular; one thus obtains a disk shaped container.

DESCRIPTION OF THE DRAWINGS

While the specification concludes with claims particularly pointing out and distinctly claiming the subject matter which is regarded s the invention, it is believed that the invention, the objects and features of the invention and further objects, features and advantages thereof will be better understood from the following description taken in connection with the accompanying drawings in which:

Proceeding now to the detailed description of the drawings FIG. 1 illustrates a spherical hollow blank 1 being provided with an inlet nipple 4. The wall 2 of that sphere 1 has a thickenss which is considerably larger as compared with the thickness of the wall 2' of the product to be made. That product is a large spherical container 3.

For making this container a pressurized medium such as Ar is fed to the sphere 1 through the nipple 4. Previously that blank 1 has been heated to a temperature necessary to obtain the superplasticity. In the case of Ti or a Ti alloy that temperature is about 850°-950° C. The heating is obtained through a suitable furnace. The size of the container to be made will depend to a considerable extent upon the pressure applied to the sphere or the time of blowing or a combination thereof. It might be advisable to turn the sphere in order to avoid or reduce the effect gravity may have on the forming process.

An alternative mode of procedure is to place the sphere 1 into a liquid medium that was heated and thereby the requisite thermal energy is imparted upon this sphere 1 causing it to be heated to obtain a superplasticity temperature. In addition certain buoyancy effect is established and that reduces the effect gravity has on the forming process. In any event it can readily be seen that a spherical container can be made.

Figure 1:
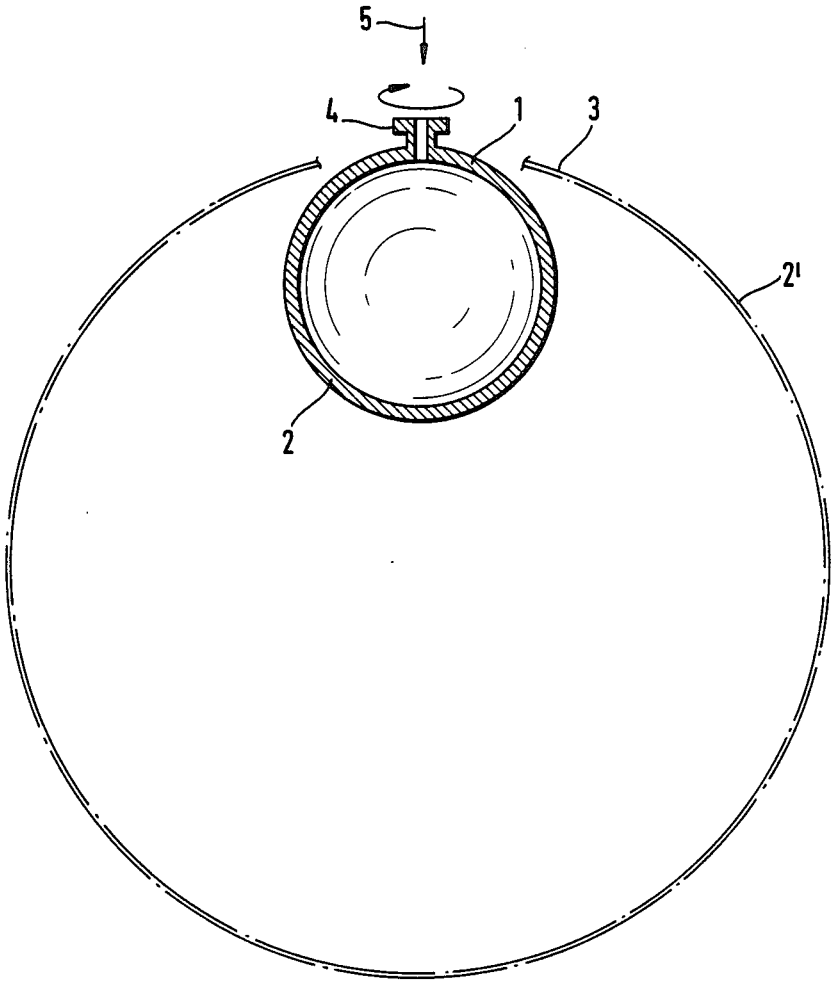
FIG. 1 illustrates two phases of the container making in accordance with the preferred embodiment of the present invention; the container being of spherical configuration.
Figure 2:
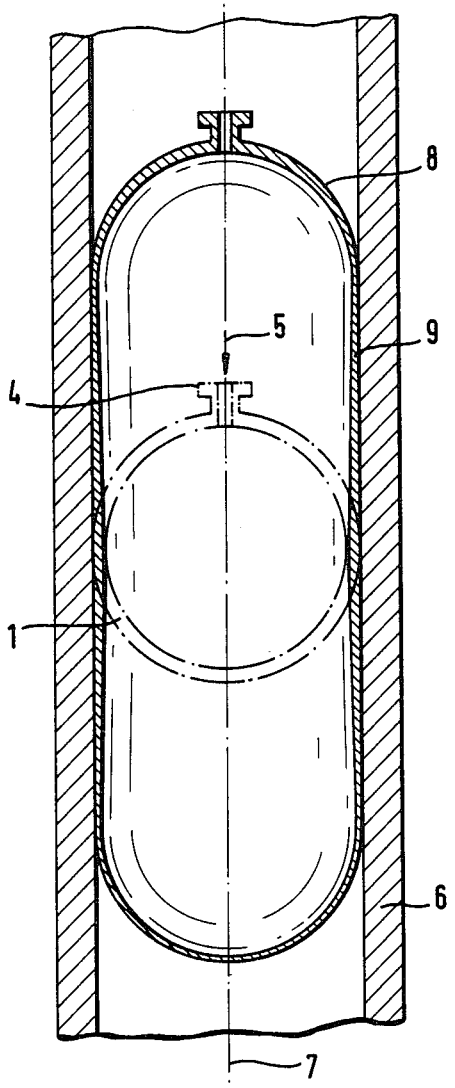
FIG. 2 illustrates the cross section through equipment for making a flat or flask shaped container.

Proceeding now to the description of FIG. 2 it should be mentioned that FIG. 2 can be given two interpretations. 6 is either a tube or the two cross sections shown through the tube wall can be interpreted as two cross sections. In any event an interior space 7 is provided and the sphere 1 is placed in that interior space of the tube (or between the plugs) 6. If 6 is a tube, sphere 1 can expand in one direction only and a flask or a bottle kind of container obtains because expansion is confined in at least two directions. If the cross section 6 is interpreted as denoting two plates then the expansion will be in two directions and confined in the third one and one obtains a round flat container expansion.

Owing to the particular process involved in this case the central part as 9' of the wall will be thicker than the outer part such as 9''. This is actually an advantage since the load on such container is larger on the central and flat part than at the ends; now such a condition is automatically considered and taken care of by the particular process involved.

The invention is not limited to the embodiments described above but all changes and modifications thereof not constituting departures from the spirit and scope of the invention are intended to be included.

I claim:

1. Method of making a container comprising the steps of:

providing a hollow spherical blank made of a material which exhibits superplasticity at particular temperatures including the step of providing a connection nipple to that hollow sphere;

heating said spherical blank to one of said particular temperatures necessary to obtain superplasticity therein;

feeding pressurized gas into that hollow sphere so as to expand the hollow sphere to a considerably larger container; and rotating the hollow sphere during expanding.

2. Method as in claim 1 wherein the blank is unconfined during expansion.

3. Method as in claim 1 wherein the blank is confined in at least one direction.

4. Method as in claim 1, using Ti or a Ti alloy as the material.

5. Method of making a single piece unitary fuel tank for space vehicles comprising the steps of:

providing a hollow spherical blank made of a material which exhibits superplasticity at particular temperatures including the step of providing a connection nipple to that hollow sphere;

heating said spherical blank to one of said particular temperatures necessary to obtain superplasticity therein;

feeding pressurized gas into that hollow sphere so as to expand the hollow sphere to a fuel tank of considerably larger dimensions; and rotating said hollow blank during expanding.

6. Method as in claim 5 wherein the blank is unconfined during expansion.

7. Method as in claim 5 wherein the blank is confined in at least one direction.

8. Method of making a single piece unitary fuel tank for space vehicles comprising the steps of:

providing a hollow spherical blank made of Ti or a Ti alloy which exhibits superplasticity at particular temperatures, including the step of providing a connection nipple to that hollow sphere;

heating said spherical blank to one of said particular temperatures necessary to obtain superplasticity therein;

feeding pressurized gas into that hollow sphere so as to expand the hollow sphere to a fuel tank of considerably larger dimensions; and rotating said hollow bank during expanding.

9. Method as in claim 8 wherein the blank is unconfined during expansion.

10. Method as in claim 8 wherein the blank is confined in at least one direction.

* * * * *